US005676027A

United States Patent [19]

Munini

[11] Patent Number: 5,676,027

[45] Date of Patent: Oct. 14, 1997

[54] DEVICE TO UNSCREW CAPS OR STOPPERS

[75] Inventor: Dino Munini, S.Quirino, Italy

[73] Assignee: Microstamp Srl, S.Quirino, Italy

[21] Appl. No.: 623,813

[22] Filed: Mar. 29, 1996

[30] Foreign Application Priority Data

Apr. 6, 1995 [IT] Italy ..... UD95A0061

[51] Int. Cl.[6] ..... B67B 7/02

[52] U.S. Cl. ..... 81/3.42; 81/155

[58] Field of Search ..... 81/3.42, 155, 157, 81/164, 175

[56] References Cited

U.S. PATENT DOCUMENTS

| | | | |
|---|---|---|---|
| 1,262,682 | 4/1918 | Leo | 81/155 |
| 1,394,033 | 10/1921 | McLeod . | |
| 1,638,185 | 8/1927 | Craig . | |
| 1,921,980 | 8/1933 | Porte | 81/155 |
| 3,046,821 | 7/1962 | Legris | 81/164 |

FOREIGN PATENT DOCUMENTS

| | | |
|---|---|---|
| 481099 | 4/1992 | European Pat. Off. . |
| 2263471 | 7/1993 | United Kingdom . |

*Primary Examiner*—D. S. Meislin

*Attorney, Agent, or Firm*—Antonelli, Terry, Stout & Kraus, LLP.

[57] ABSTRACT

Device to unscrew caps or stoppers, which is suitable to cooperate with a screw cap (25) or with a mushroom-shaped stopper of a bottle and comprises an overturned bowl element (12) associated with a radially disposed connecting element (14) cooperating with an axially rotatable handle (11), the bowl element (12) defining a first positioning and containing seating (13) with which the cap or stopper (25) cooperates momentarily, the connecting element (14) containing a second longitudinal seating (15) including a female screw-threaded segment (20) with which a male screw-threaded slider (18) cooperates, the slider (18) being rotatably clamped but free to slide longitudinally in the handle (11) between a fully retracted position and a fully advanced position and comprising at its front end a clamping element (32), which cooperates with the first and containing seating (13) for the cap or stopper (25) when the slider (18) is in an advanced position, the clamping element (32) being rotatably clamped but free to slide axially in the second longitudinal seating (15).

6 Claims, 2 Drawing Sheets

DEVICE TO UNSCREW CAPS OR STOPPERS

BACKGROUND OF THE INVENTION

This invention concerns a device to unscrew caps or stoppers.

To be more exact the invention concerns a device to unscrew caps or stoppers which can be gripped and operated by hand and is suitable to screw/unscrew screw caps and to remove mushroom-type stoppers made either of plastic or of cork.

As is known, screw caps have on their inside a female screw thread which cooperates with a mating male screw thread formed on the upper end part of the neck of a bottle.

So as to ensure a correct seal engagement, the caps are screwed onto the male screw thread of the bottle whenever the bottle is closed so as to avoid any escape of the liquid or any entry of extraneous substances into the bottle and also to ensure unchanging organoleptic characteristics of the liquid contained in the bottle.

Above all, but not only, where sweetened effervescent drinks are concerned, it may happen that the cap tends to be blocked in a closed position, thus making the unclamping operations difficult.

Pincer-type devices have been provided to assist a unclamping of the cap; in these devices the screw cap is gripped between jaws consisting of two opposed elements or of one single element partly surrounding the perimeter of the cap, these elements being associated with actuation levers which have to be tightened together to ensure engagement against the cap.

These devices require a user to perform at the same time the clamping of the cap by acting on the levers associated with those jaws and also the rotation of the unscrewing device in relation to the bottle, thus making such operations rather difficult, above all for women and children.

It follows that the operation may be not only tiring but also dangerous since the user may make sharp and uncontrolled movements which may lead to the user being wounded.

SUMMARY OF THE INVENTION

The present applicants have designed, tested and embodied this invention to overcome the shortcomings of the state of the art and to achieve further advantages.

The purpose of this invention is to provide a device to unscrew caps or stoppers which makes possible this operation in a controlled and safe manner on the screw caps or mushroom-type stoppers and enables possible slipping or sliding of the device against the cap or stopper to be avoided.

The device according to the invention enables the cap or stopper to be screwed or unscrewed in two separate successive steps, thus making the operations more simple and capable of being carried out even by children or women.

To be more exact, the device according to the invention in the first step is made momentarily firmly fixed to the cap or stopper, whereas the second step is the screwing or unscrewing of the cap or stopper on or from the bottle.

In the first step the device according to the invention is operated so as to exert an increasing and controlled radial pressure continuously on at least two radially opposed zones of the perimeter of the cap or stopper until the cap or stopper is clamped by being firmly engaged by the device.

In the second step the user has merely to rotate the device in relation to the bottle, or viceversa, so as to perform the operation of clamping or unclamping the cap or stopper, this operation requiring very little force and involving no danger.

The device according to the invention is easy to use, does not require great force, makes possible a good engagement of the cap or stopper and also is not dangerous for the user or other people.

The device of the invention consists of a longitudinally constrained hollow handle free to be rotated axially in relation to an overturned bowl element defining a seating for the positioning and containing of the cap or stopper This bowl element includes in a radial position a hollow connecting element containing a longitudinal seating communicating with the interior of the positioning and containing seating of the bowl element, and also containing a female screw-threaded segment.

The handle is associated with the connecting element by being clamped thereto longitudinally but is free to rotate in relation to that element.

An axially movable slider rotatably clamped to the handle cooperates with the longitudinal seating within the connecting element; this slider includes an external male screw-threaded portion which cooperates with a female screw-threaded segment of the longitudinal seating within the connecting element.

This slider comprises at its front end a clamping element, which advantageously has its forward surface shaped as an arc of a circle and is clamped longitudinally to the slider but is free to rotate in relation to the slider.

This clamping element is rotatably clamped but is free to slide within the longitudinal seating within the connecting element.

Thus, if the handle is rotated axially in relation to the bowl element, the slider is set in rotation and, meshing with the female screw-threaded segment of the seating within the connecting element, moves forward or retreats in relation to that connecting element and carries with it the clamping element.

When moving forward, the clamping element protruding from the seating in the connecting element clamps the cap or stopper against the opposite wall of the positioning and containing seating of the bowl element.

During the unscrewing operation according to the invention the forward face of the clamping element and/or the wall of the containing seating opposite to the clamping element include advantageously anti-slip means consisting in this case of knurls so as to prevent the cap or stopper being able to slip during the screwing or unscrewing operations.

The forward movement or retraction of the slider is achieved by rotating axially the handle in one direction or the other in relation to the bowl element which positions and contains the cap or stopper.

During the unscrewing operations according to the invention the screw thread of the slider at the end of the travel of retraction of the slider is freed from the mating screw thread of the longitudinal seating within the connecting element.

The rear portion of the slider cooperates with resilient abutment means, which thrust the slider resiliently into contact with the connecting element so that, if the handle is rotated again in the direction of forward movement, the screw threads mesh at once and the slider moves forward within the longitudinal seating of the connecting element.

The resilient abutment means can be anchored equally well to the rear portion of the slider or to the rear end of the handle.

In a special form of embodiment the resilient abutment means can be an integral part of the slider or of the handle.

According to a variant the resilient abutment means are embodied with auxiliary elements.

BRIEF DESCRIPTION OF THE DRAWINGS

The attached figures are given as a non-restrictive example and show a preferred embodiment of the invention as follows.

DETAILED DESCRIPTION OF THE PREFERRED EMBODIMENTS

Figure 1:
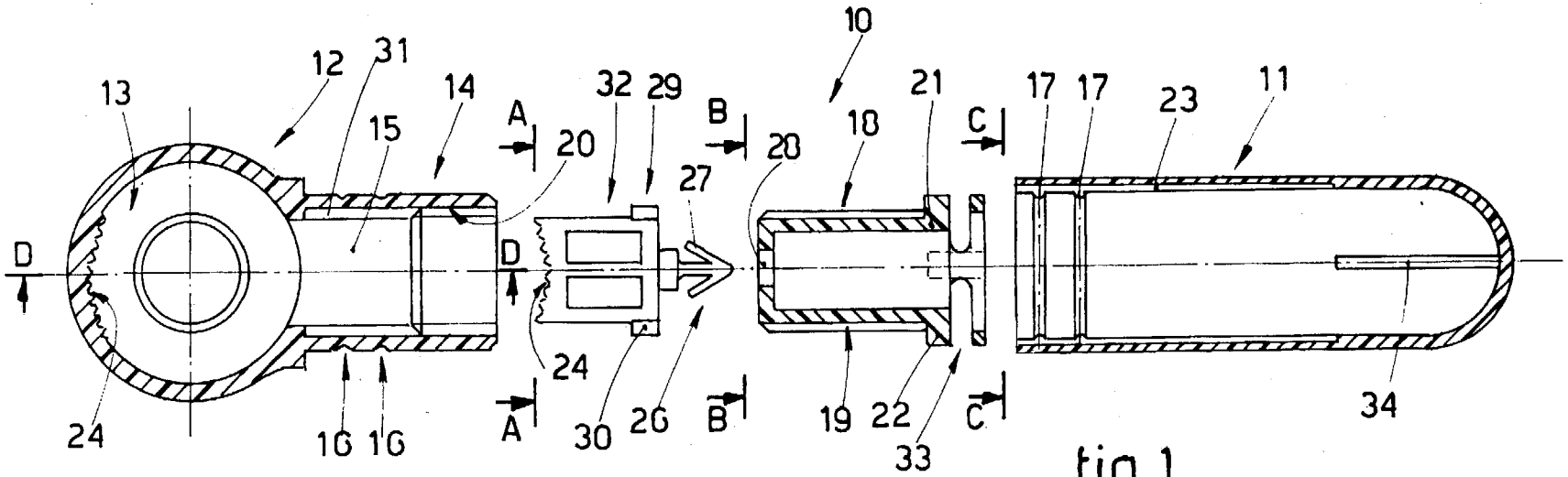
FIG. 1 shows a knock-down longitudinal section of the device to unscrew caps or stoppers according to the invention.
Figure 4:
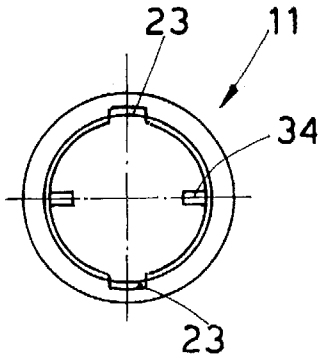
FIG. 4 shows a view of the handle along the line C—C of FIG. 1.
Figure 3:
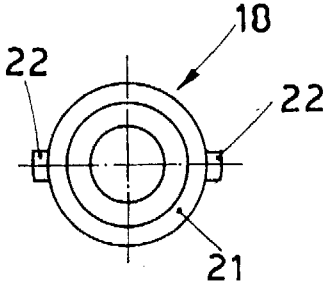
FIG. 3 shows a view of the slider along the line B—B of FIG. 1.
Figure 2:
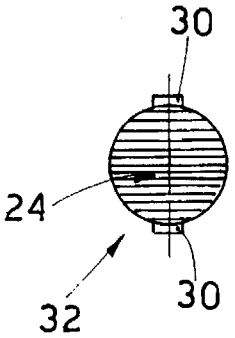
FIG. 2 shows a view of the clamping element along the line A—A of FIG. 1.
Figure 6:
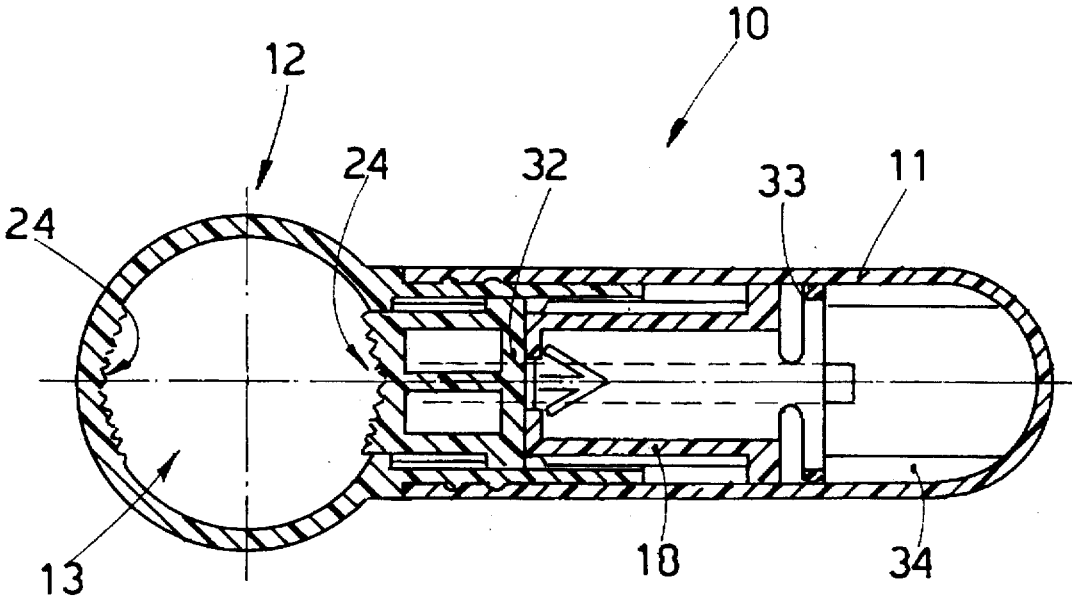
FIG. 6 shows a section of the unscrewing device of FIG. 1 in an assembled position.
Figure 5:
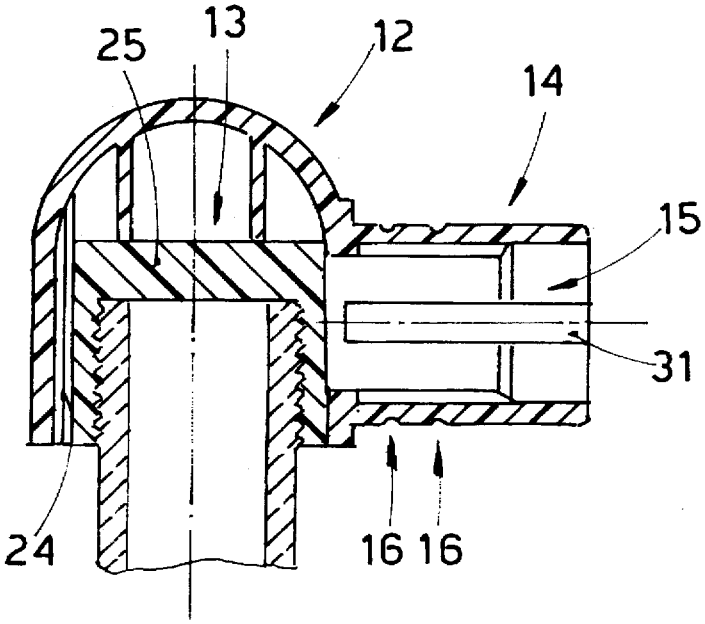
FIG. 5 shows a section of the bowl element along the line D—D of FIG. 1 in cooperation with a cap of a bottle.

The reference number 10 in the figures denotes a device to unscrew caps or stoppers according to the invention.

The device 10 according to the invention is applied to bottles closed with a screw cap containing a female screw thread which cooperates with a male screw thread of a mating shape on the neck of the bottle.

The device 10 according to the invention is applied also to bottles closed with a mushroom-type stopper, The device 10 to unscrew caps or stoppers according to the invention comprises a handle 11, which is open at one end, is longitudinally constrained but is free to rotate in relation to an overturned bowl element 12, which is associated with that open end and includes a first positioning and containing seating 13 with which a cap or stopper 25 of a bottle cooperates momentarily.

The bowl element 12 includes a radial connecting element 14 containing a second internal longitudinal seating 15 communicating with the first positioning ,and containing seating 13 for the cap or stopper 25.

In this case, the first positioning and containing seating 13 includes, at least on the sidewall opposite to the connecting element 14, anti-slip means 24 which enhance the circumferential clamping of the cap or stopper 25.

In this example, the connecting element 14 has on its exterior two first circumferential grooves 16, with which there cooperate two first internal circumferential ridges 17 on the handle 11 so as to clamp those two elements 14 and 11 together longitudinally but to leave them free to rotate reciprocally.

The second internal longitudinal seating 15 contains an internal female screw-threaded segment 20 with which there cooperates a slider 18 including a male screw-threaded segment 19.

The slider 18 is free to slide longitudinally within the handle 11 but is rotatably clamped in relation to the handle 11.

In this case, the slider 18 includes at its rear end a ring 21 having a diameter greater than the male screw-threaded segment 19 and including two second longitudinal ridges 22 which cooperate with two second grooves 23 located in a coordinated position in the handle 11.

The slider 18 includes at its front end a clamping element 32 consisting of a clamping segment having at its front end a conformation shaped substantially as an arc of a circle and mating substantially with the form of the cap or stopper 25 and equipped with analogous anti-slip means 24.

This clamping element 32 is clamped longitudinally but is free to rotate axially in relation to the slider 18.

In this case the clamping element 32 includes at its rear end anchorage means 26 consisting of diverging resilient fins 27, which become fixed in an anchorage hole 28 machined in the front portion of the slider 18.

The clamping element 32 includes means 29 to prevent rotation in relation to the longitudinal seating 15 within the connecting element 14.

In this case the means 29 to prevent rotation consist of two third longitudinal ridges 30 which cooperate with two third longitudinal grooves 31, which have a mating form and are included in the second internal longitudinal seating 15.

In this example the slider 18 includes at its rear end resilient abutment means 33 which cooperate with stationary abutment means 34 associated with the rear end of the handle 11.

When the slider 18 has been brought to its fully retracted position, the male screw-threaded segment 19 of the slider is released from the female screw-threaded segment 20 of the second internal longitudinal seating 15.

The screw-threaded segments 19 and 20, however, are thrust together resiliently to ensure their cooperation with each other as soon as the handle 11 has been rotated in the direction of forward movement of the slider 18.

In this case the resilient abutment means 33 are an integral part of the slider 18.

According to a variant which is not shown here, the resilient abutment means 33 are auxiliary elements associated with the rear end of the slider 18 or with the stationary abutment means 34 in the handle 11.

I claim:

1. Device to unscrew caps or stoppers, which is suitable to cooperate with a screw cap or with a mushroom-shaped stopper of a bottle, characterised in that the device comprises an overturned bowl element having a radially disposed connecting element cooperating with an axially rotatable handle, the bowl element defining a first positioning and Containing seating with which the cap or stopper cooperates momentarily, the connecting element containing a second longitudinal seating including a female screw-threaded segment with which a male screw-threaded slider cooperates, the slider being rotatably clamped but free to slide longitudinally in the handle between a fully retracted position and a fully advanced position and comprising at its front end a clamping element, which cooperates with the first positioning and containing seating for the cap or stopper when the slider is in an advanced position, the clamping element being rotatably clamped but free to slide axially in the second longitudinal seating.

2. Device to unscrew caps or stoppers as in claim 1, whereby in the position of full retraction of the slider, the male screw-threaded segment of the slider is freed from the female screw-threaded segment of the second longitudinal seating within the connecting element.

3. Device to unscrew caps or stoppers as in claim 2, whereby the slider cooperates at its rear with resilient abutment means.

4. Device to unscrew caps or stoppers as in claim 3, whereby the resilient abutment means are anchored to the slider.

5. Device to unscrew caps or stoppers as in claim 1, whereby the first positioning and containing seating includes an anti-slip surface at least on the sidewall opposite to the connecting element.

6. Device to unscrew caps or stoppers as in claim 1, whereby the forward surface of the clamping element includes an anti-slip surface.

* * * * *